United States Patent [19]

D'Angelo et al.

[11] Patent Number: 4,524,963

[45] Date of Patent: Jun. 25, 1985

[54] DOCUMENT HANDLING DEVICE

[75] Inventors: Kenneth R. D'Angelo, Bridgewater; Timothy T. Childress, Manchester, both of Conn.

[73] Assignee: Scan-Optics, Inc., East Hartford, Conn.

[21] Appl. No.: 458,573

[22] Filed: Jan. 17, 1983

[51] Int. Cl.[3] ..... B65H 5/22

[52] U.S. Cl. ..... 271/3.1; 271/34; 271/122; 271/197

[58] Field of Search ..... 271/3.1, 197, 181, 178, 271/314, 34, 35, 195, 10, 122, 272, 275, 200, 201

[56] References Cited

U.S. PATENT DOCUMENTS

| | | | |
|---|---|---|---|
| 3,193,280 | 7/1965 | Gutierrez | 271/179 |
| 3,485,489 | 12/1969 | Lindquist | 271/34 |
| 3,690,474 | 9/1972 | Klappenecker | 271/3.1 X |
| 3,988,017 | 10/1976 | Kyhl | 271/10 |

*Primary Examiner*—Bruce H. Stoner, Jr.
*Assistant Examiner*—John A. Carroll
*Attorney, Agent, or Firm*—Brumbaugh, Graves, Donohue & Raymond

[57] ABSTRACT

A stacking and feeding device of document-handling equipment for documents moving along one of their edges, includes a transporting conveyor belt system that forces the documents against a stop where they begin to stack up in the horizontal direction in the order in which they arrive. A feeder rides on the outermost document of the stack and slides along guide shafts as the size of the stack changes. The feeder is selectively actuated to remove the documents from the stack one at a time in the order in which they entered the stack. A swing arm is pivotally and extensibly connected between the feeder and the following stationary part of the equipment so that the documents can be delivered thereto, regardless of the position of the feeder.

14 Claims, 5 Drawing Figures

DOCUMENT HANDLING DEVICE

BACKGROUND OF THE INVENTION

The present invention relates to document-handling systems and, more particularly, to document-handling systems in which information must be imaged from a document that is transported automatically through a machine.

In document scanning devices, such as character recognition systems or copiers, a good deal of time and effort can be wasted if it is necessary to locate each document by hand in a position which will allow the information on the document to be read or copied. Either system usually requires segments of a document to be optically scanned. In order to preserve the information carried by the document, its movement through the scanning section of the machine must be relatively slow. However, the movement through other parts of the machine may be relatively fast. Thus, there is a tendency for paper to build up into a stack in the machine in those sections prior to a slow operation; e.g. scanning. In order to accomplish this, some form of buffer must be provided to accommodate the stack of documents.

In some prior art systems stacks of documents at the input to the scanning section are stacked in an automatic elevator. Such a system is disclosed in U.S. Pat. No. 4,171,129 of Daley et al., which is assigned to the assignee of the present invention. With the arrangement disclosed in that patent, a horizontal stack of documents is manually loaded onto an elevator. The elevator positions the topmost document under a feed roller which moves it into a pair of paper-separating rollers. The top roller of the pair moves in the same direction as the feed roller, but the other roller moves in the opposite direction so as to push back into the stack any documents pulled along with the topmost document. Once the document has passed through the separating rollers, it is aligned and scanned at slow speed. Then it is rapidly moved into a storage bin.

The elevator of the above-identified Daley et al. patent is useful as an input to an automatic document tranport, but it could not be used in the middle of such a system in which documents were automatically moved at a high speed through initial operations and then automatically stacked and fed at a slower speed into a subsequent operation. In addition, the document elevator in the prior patent is adapted to handle a stack of documents lying flat, i.e. horizontal, and could not automatically stack vertically-arranged documents, i.e. documents being transported on one edge.

SUMMARY OF THE INVENTION

The present invention is a document transport device with means for automatically stacking documents moving upright on their edge at one speed, and thereafter feeding these documents along at a second speed in the same order in which they were received.

A stacker section receives each incoming document, and moves the upright document in a longitudinal direction, in a horizontal plane, to a position behind a stack of upright documents. The incoming document is stopped and released upright onto the back of the stack of documents, to become the last document in the stack. As additional documents are received in the stacker section, they are added successively to the back of the stack.

The stack is retained between a feeder section and the stacker section, which engage the first and last documents in the stack, respectively. The two sections are movable relative to one another in a horizontal plane to accommodate growth in the size of the stack. The feeder, which engages the front document of the stack, is arranged to feed intermittently the front document from the stack by sliding it longitudinally from the stack to a swing arm section, the document remaining upright. The swing arm section is pivotably connected between the movable feeder structure and the next section of the machine, which is generally stationary, to provide a paper path to the next section of the machine which is movable to accommodate various positions of the feeder section.

In accordance with the invention, incoming documents are added to the back of the stack and stored until required for further processing by the stacker section. Independently of the incoming documents, documents are removed, in the order in which they came in, from the front of the stack by the feeder section. Incoming documents move longitudinally through the stacker, transversely toward the front of the stack, which acts as a storage buffer, and then longitudinally again from the feeder for further processing, at all times remaining upright.

In an illustrative embodiment of the invention, documents traveling upright on their edges pass between a guide and a plurality of vertically spaced porous belts, moving horizontally. The belts are located against a vacuum manifold which holds the document against the belts while the belts move it against a stop. The stop is adjacent a stack of documents so as to align the incoming document with the stack. Once the document engages the stop, it is separated from the belts to form the last document in the stack. As the next document arrives, it is pulled behind the first by the belts so that it now becomes the last document in the stack and the previous document moves transversely foward. Thus a stack of documents positioned on their edges is formed in a buffer section of the machine, with the most recent incoming document being against the stacker section belts.

A feeder belt of a feeder section, which is normally stationary, engages the front document of the stack, i.e. the first-to-arrive, such that the stack of documents is held and maintained upright between the stacker section and the feeder section. The feeder section is mounted on slide shafts so that it can be moved, in the horizontal plane, toward and away from the stacker section, to accommodate growth in the size of the stack. Preferably, the stop is attached to the feeder section, to move with it.

When documents are needed in the remaining parts of the machine, a clutch is engaged to actuate the feeder belt of the feeder section and slide the front document from the stack, i.e., move it in a direction in the plane of the document. As the front document separates from the stack, it engages another belt of the feeder section, disposed on the stack side of the document, turning in the opposite direction. At this point, the document is disposed between the feeder belt, which is pushing the document forward, and the stack-side belt, moving in the opposite direction, and the oppositely moving belt pushes back into the stack any documents entrained with the first. In order to get the document from the movable feeder section to the following stationary section of the machine, a swing arm section is pivoted to the feeder section and to slide shafts on the following stationary section. Belts on the swing arm section guide each document to the next section of the machine.

BRIEF DESCRIPTION OF THE DRAWINGS

The foregoing and other features of the present invention will be more readily appararent from the following detailed description and drawings of an illustrative embodiment of the invention in which.

DESCRIPTION OF AN EXEMPLARY EMBODIMENT

Figure 1:
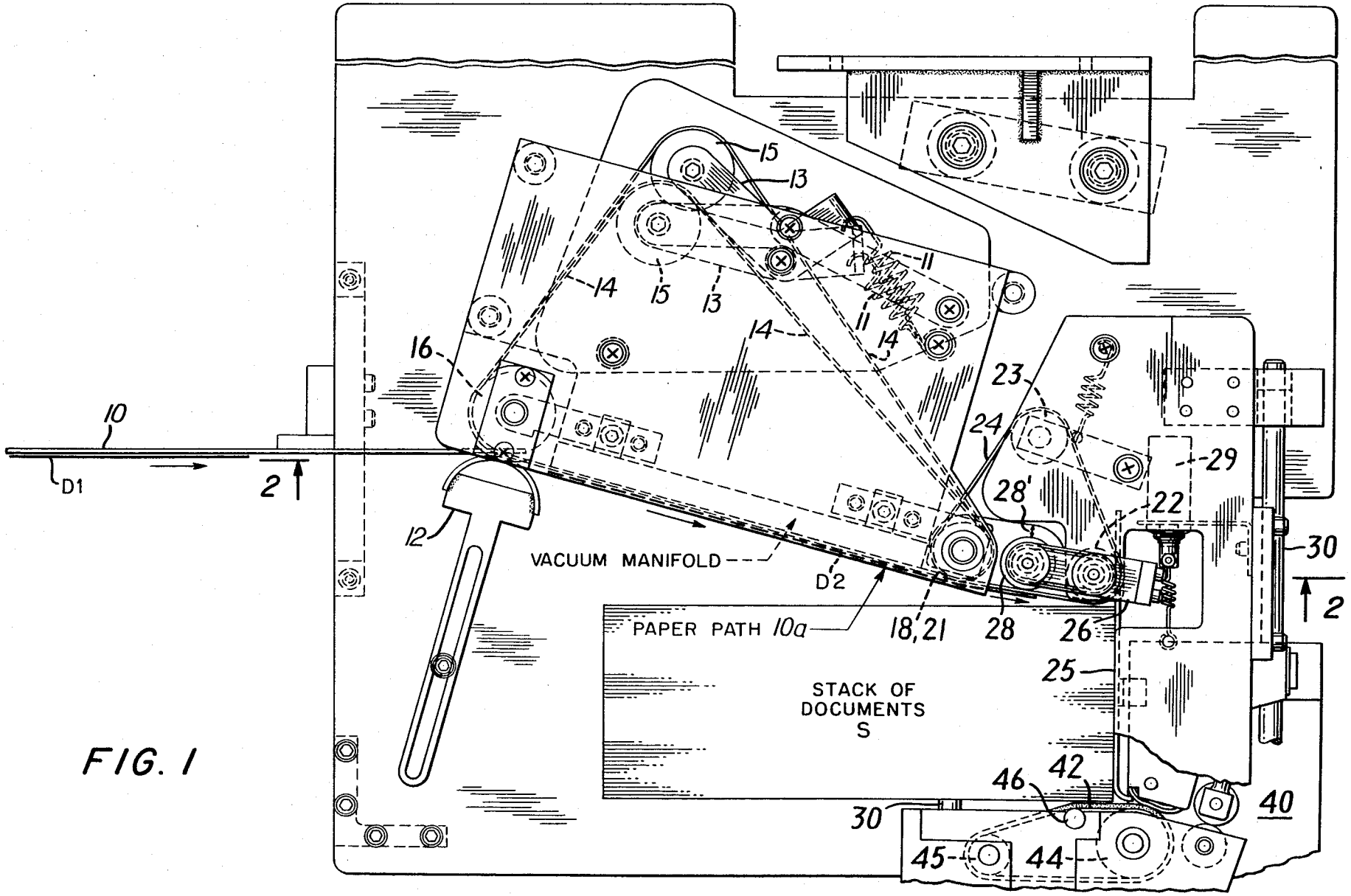
FIG. 1 is a top view of a stacker section according to the present invention.
Figure 2:
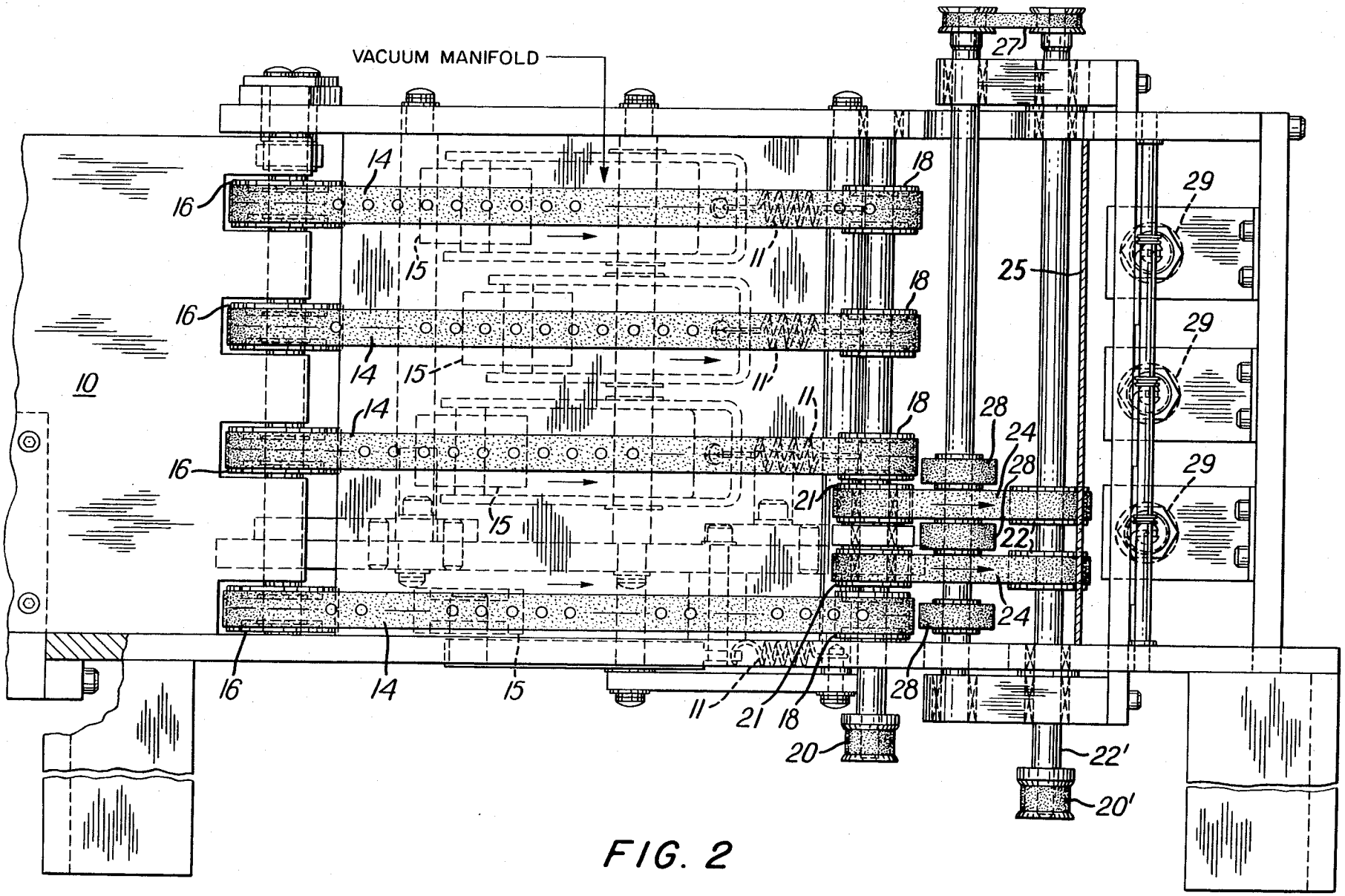
FIG. 2 is a front sectional view of the stacker section of FIG. 1 along line II—II.
Figure 3:
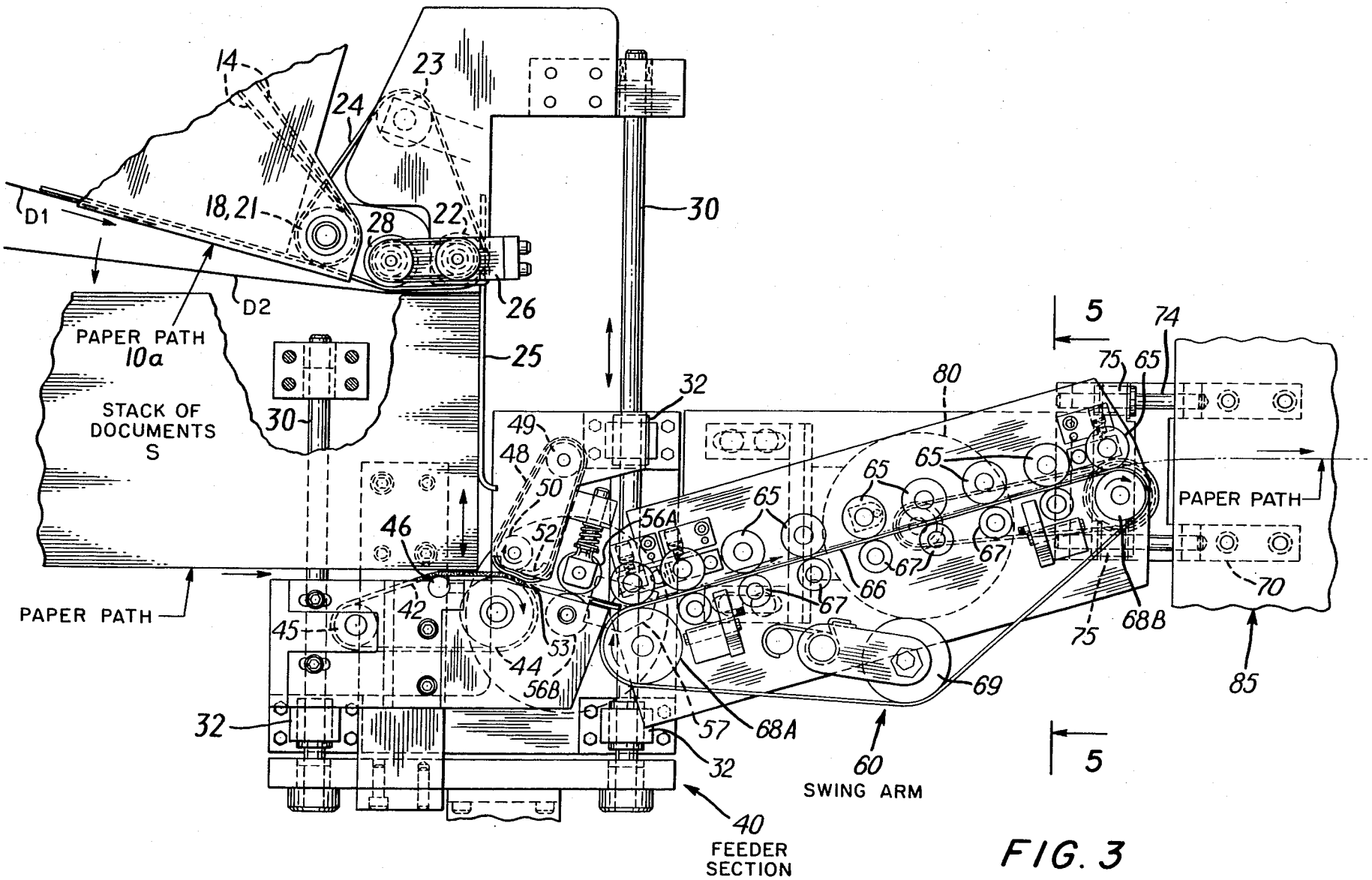
FIG. 3 is a top view of feeder and swing arm sections following the stacker of FIG. 1.
Figure 4:
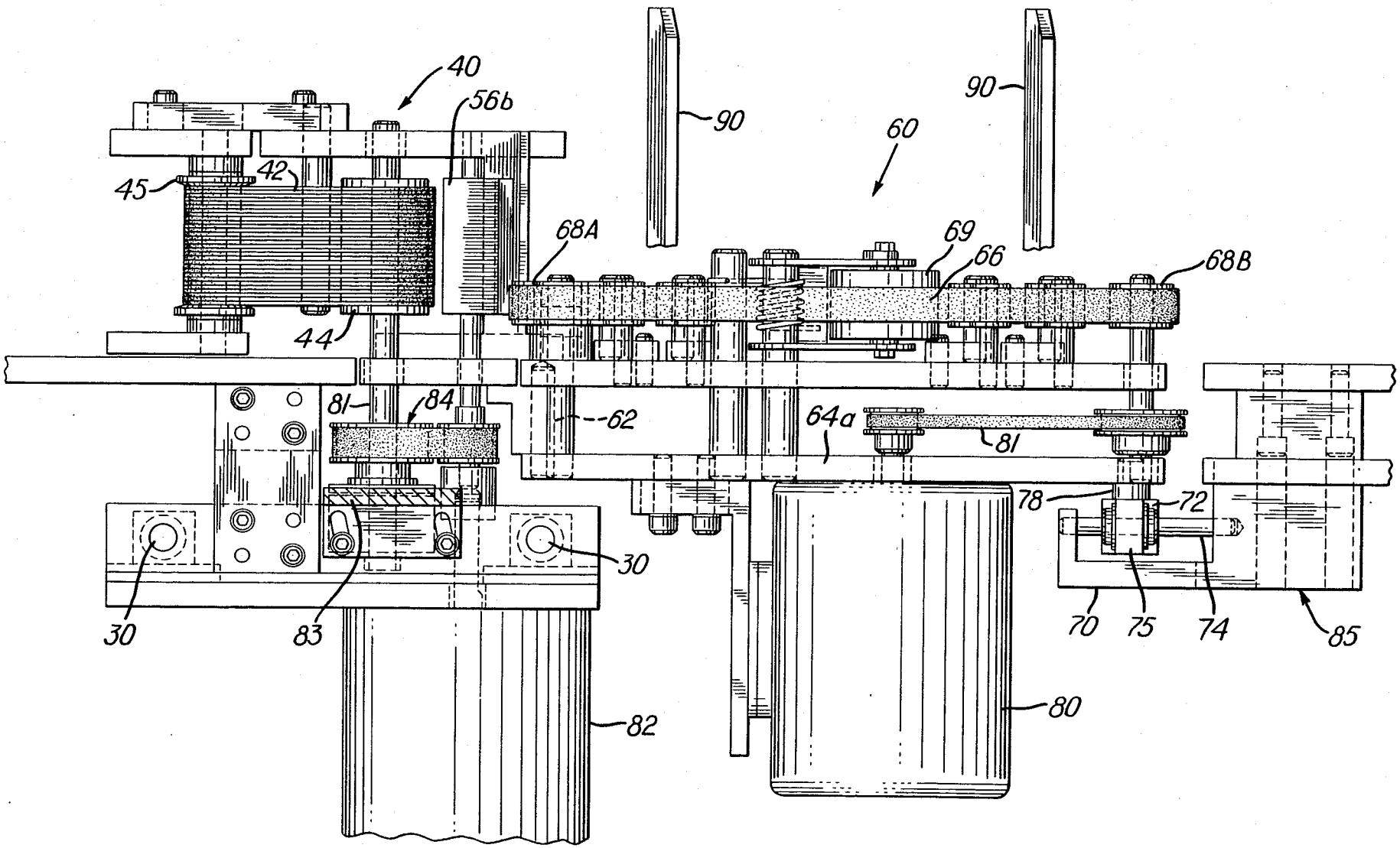
FIG. 4 is a front view of the feeder and swing arm sections of FIG. 3.

FIGS. 1 and 2 show the construction of a stacker section which forms a stack of documents in an automatic document-handling machine, and thereby provides a buffer for storing incoming documents delivered from one section of the machine until such time as they are required for further processing in another section of the machine. The feeder 40 and swing arm 60 sections, which selectively remove the stored documents from the stack and transport the documents to the next section of the machine, are shown in FIGS. 3 and 4.

In FIG. 1, a flexible document D1 is shown at the left side entering the machine along entrance plate 10, while traveling in a longitudinal direction, in a horizontal plane, in an upright position, i.e. on its edge. As used herein, the term "longitudinal" or the like refers to a direction of movement in the plane of the document, whether such movement is in the direction of the length or the width of the document. The documents may be of various thicknesses and weights.

After traveling along the entrance plate 10, the documents contact a guide 12 which forces them against a plurality of vertically-spaced (see FIG. 2) belts 14 traveling over rollers 16. The belts 14 move horizontally along a paper delivery path 10*a* to a set of drive rollers 18, which are mounted on a common, vertically extending shaft driven by a pulley 20 (FIG. 2). The pulley 20 is in turn driven by belts leading to a motor (not shown). A take-up roller 15 under the influence of a spring 11 and (spring loaded) idler arm 13, engages each belt 14 to keep the respective belt 14 under tension. As shown in FIGS. 1 and 2, the take-up rollers 15 and associated idler arms 13 are mounted somewhat differently for the different belts 14, the rollers being staggered in the embodiment shown to avoid interference. Each take-up roller 15 performs the same function, however, i.e. guides the belt 14 and keeps it under tension.

Along the paper or document path 10*a* between rollers 16 and 18 there is a manifold (designated as "Vacuum Manifold") which has a plurality of holes measuring, for example, 0.040 inches. A source of vacuum and a source of compressed air may be alternatively supplied to the manifold, controlled by a switching valve. As a document, e.g. D2, moves along path 10*a*, vacuum in the manifold draws the documents towards the manifold to keep it upright against the belts. Preferably, the vacuum is applied to documents through the belts 14. For this purpose, the belts 14 have a series of spaced holes, for example $\frac{1}{8}$ inch in diameter, which are positioned at the level of the corresponding holes in the vacuum manifold.

Following rollers 18, a pair of vertically-spaced, horizontally moving short belts 24 loop over rollers 21, which are on the same shaft as rollers 18, about guide plate 96, over rollers 22, and over spring-loaded take-up rollers 23. The short belts 24 direct the documents against a paper stop plate 25, which extends in a direction generally transverse to the direction of movement of the documents. As shown in FIGS. 1 and 2, the path of the belts from rollers 18 to the pulleys 22 is substantially parallel to the stack of documents S.

A series of transversely extensible rollers 28 may optionally be provided. The rollers 28 are mounted on pivot arms 26, which pivot about shaft 22', and are displaceable in the direction of the arrow 28'. As shown in FIG. 2, the rollers 28 are able to move forward of the vertical plane of the belts 24. The extendable rollers 28 are driven from the shaft 22' via a pulley belt 27. This shaft 22' itself may be driven by a motor (not shown) via a pulley belt and the pulley 20'.

In their retracted position as shown in FIG. 1, the rollers 28 are behind the vertical plane of the belts 24. When moved to the extended position (see FIG. 3), the rollers 28 move forward of the plane of the belts 24 so as to push the document away from the short belts 24 and assist in positioning the document against the document stack "S" as described below.

As best shown in FIG. 1, the entering documents, e.g. D2, which are held against the belts 14 by vacuum, engage the stop 25. Due to the presence of the guide plate 96, the forward end of the document is substantially parallel to the stack S and captured between the stack S and the belts 24. This helps prevent buckling of the documents. Upon engagement of the stop plate 25, a solenoid 29 is activated to move rollers 28 into the extended position, as shown in FIG. 3. Extension of the rollers 28 pushes the forward portion of the document D2 flat against the stack, and causes the rear edge of the document D2 to break away from the vacuum manifold so that the following document D1 can be stacked behind it (see FIG. 3). Continued rotation of the rollers 28 and 22 urges the front edge of the document against the stop plate 25 so that the document D2 remains positioned in alignment with the stack. To aid in this operation, photocells (not shown) may be located along the manifold or belts 24 to generate a signal when the document is near the stop 25, to activate the solenoids 29. At the same time, the signal causes the air control valve to the manifold to switch from the vacuum line to the compressed air line, so that a puff of air from the manifold blows the rear portion of the document away from the belts 14.

As additional documents move along the belts 14 and contact stop 25, they are stacked one behind the other to form the stack S, which extends forward in FIG. 1, so the first document received is the outermost document in FIG. 1. Pressed against the outermost document of the stack is a feeder section 40, which as shown in greater detail in FIG. 3, is mounted on slide shafts 30 by Thompson bushings 32. The feeder section is thus slideable towards and away from the stacker section. Preferably, as shown in the figures, the paper stop 25 is mounted on the feeder section so as to move with it.

FIG. 3 shows the machinery with the stacker nearly full. When the machinery is first started up, i.e. prior to there being any stack of documents, the feeder section is displaced up against the belts 24 of the stacker section. As the stack grows, the feeder section 40 moves further away from the stacker section, toward the position shown in FIG. 3. The displaceability of the feeder section relative to the stacker section can be chosen in accordance with the requirements of the particular machinery. By way of example, to accommodate a maximum stack size of 1,000 documents, the feeder is constructed to travel along the slide shafts 30 approximately 6 inches.

The feeder section 40 (FIGS. 3 and 4) includes a feeder belt 42 which travels over rollers 45 and 46 and engages the front document of the stack. The feeder belt 42, which is normally stationary, is intermittently driven by roller 44 as described below. In contact with the feeder belt 42, just beyond the curved forward edge of the stop plate 25, is a separator belt 48 which is driven by a roller 49 and travels over a roller 50. A guide plate 52 assures that there is a section of the separator belt 48 that is in contact with the feeder belt 42, i.e. section 53 in the drawing of FIG. 3. The rollers 44 (when actuated) and 50 both turn in a clockwise direction, and thus the belts 42, 48, along section 53, move in opposite directions. The separator belt 48 runs substantially slower than the feeder belt 42 so as not to prevent the removal of the front sheet of paper from the stack, but will engage any additional sheets of paper carried along from the stack so as to effect a paper separation and return the additional sheets to the stack.

The feeder belt 42 is made of a material with a low durometer, e.g. soft rubber. Preferably, the belt has spaced grooves to facilitate gripping of the paper. As shown, the grooves run in the longitudinal direction of the belt, i.e. the direction of paper movement, and help increase friction between the belt 42 and paper by conforming to the paper surface. Also, any debris, which would otherwise tend to lift the belt surface away from the paper, and thereby reduce friction, is instead collected in the grooves. In an illustrative example, the belt 42 has 1/32" grooves spaced vertically at 1/32" intervals. The separator belt 48 is made of foamed polyurethane with a plastic liner. Both belts are made by the Xerox corporation and are commercially available. By using these belts it is possible to accept automatically paper of different sizes and different weights without readjusting the belt tension.

As shown in FIG. 4, the roller 44, which drives the feeder belt 42, is mounted on a drive shaft 81. The drive shaft 81 is selectively coupled to a constant speed motor 82 by way of a clutch assembly 83, which is actuated by an input signal to the feeder. The input signal may originate from sections of the document handling machinery downstream of the feeder and swing arm sections, i.e. when such sections are ready to receive the next document; the particular origin of such signal does not form part of the present invention.

Any suitable clutch arrangement may be employed for selectively coupling the motor 82 and drive shaft 81. By way of example, a magnetically actuated brake clutch, of the type sold by Inertia Dynamics, Inc., Collinsville, Conn., may be employed.

When the clutch 83 is actuated, the feeder belt 42 drives the front or outermost document in the stack S against the belt 48 where any documents entrained with it are separated and pushed back into the stack. The front document is then captured by a pair of pinch rollers 56. The upper roller 56A is spring-loaded against the lower roller 56B. As shown in FIG. 4, the lower roller 56 may be driven off drive shaft 81 by an arrangement of belt-connected pulleys 84. The pinch rollers **56*a*, 56*b* grip the document and force it against a guide 58 that directs it into the first of a series of rollers making up the swing arm section 60**.

As discussed above, the feeder section 40 moves relative to the stationary stacker section. The remainder of the document handling machinery, the next portion of which is designated 85, is also normally stationary, and thus the feeder section 40 also moves relative to it. The function of the swing arm section 60 is to receive documents from various positions of the feeder section, and regardless of the position of the feeder section, to thereafter transport the documents to the fixed position input of the next machine portion 85.

To accommodate movement of the feeder section 40, the swing arm section 60 is pivotally connected to the feeder section 40 by a metal pin or shaft 62 which is captured in base plates 64, **64*a* of the swing arm (FIG. 4) and passes through a Delrin block 57 fastened to the feeder section 40. In attaching the feeder section to the swing arm section, the use of the Delrin block with metal pin 62** reduces friction during the pivotal movement of the swing arm section.

In the swing arm section, the upright document is guided by a belt 66 which passes over a series of middle rollers 67 and end rollers 68 positioned along the paper path. The belt 66 also extends around a tension take-up roller 69. The end rollers 68A and 68B have a larger diameter than the middle rollers 67. Pressing the paper against the belt are a number of pinch rollers 65 which are spring-loaded against the belt and pivotally mounted opposite the rollers 67, 68.

The end of the swing arm section attached to the next section of machinery 85, i.e. the end away from the feeder section 40, is pivotally mounted via a pin 78 on a carriage 72. The carriage 72 in turn is longitudinally displaceable relative to the fixed section of equipment 85 by means of a pair of Thomson ball bushings 75, which are moveable along a pair of guide shafts 74 fixed to a bracket 70. Therefore, the swing arm section can slide with respect to the stationary bracket 70, as well as pivot with respect to it, as the feeder section 40 moves in the horizontal plane during an increase or decrease in the size of the stack of paper.

Figure 5:
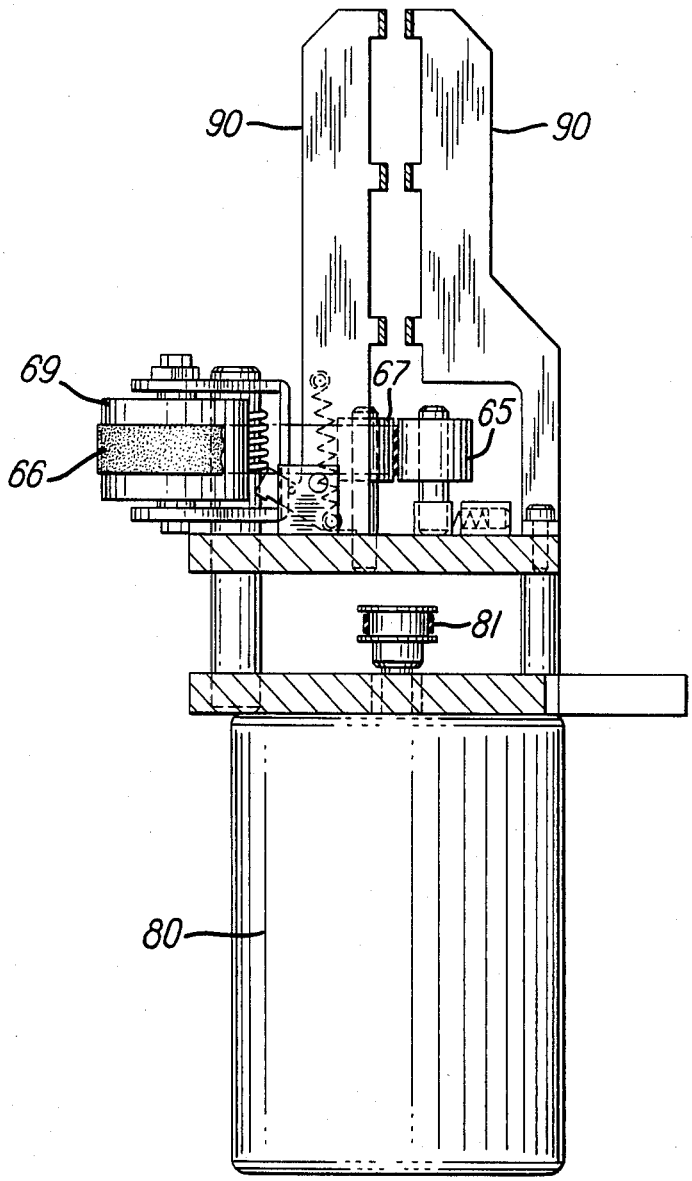
FIG. 5 is an end view of the swing arm section of FIG. 4.

A motor 80 (FIG. 4) drives a belt 94 so as to rotate the roller 68B and hence drive the belt 66 of the swing arm section. Guide supports 90 (FIGS. 4 and 5) extend over the swing arm rollers 65, 67 and lead the document into the following stationary equipment section 85. Guide plates 95 (which have been omitted from FIG. 4 for clarity) preferably extend between the supports 90.

For the feeder section to apply a constant pressure against the document stack, a series of weights (not shown) may be used which are attached to cables passing over a pulley and attached to the feeder section.

With the document handling device in accordance with the invention, it is possible to delay and store documents traveling vertically on their edges until needed at a later time for further processing. When needed, these documents are then serially passed on to the next section in the order in which they were originally received by the stacker section and stacked.

The invention possesses substantial flexibility in handling documents of different sizes, forms, and thicknesses, for example ranging from tissue to playing card thickness (16# to 100#), without adjustment.

While the present invention has been particularly shown and described with reference to a preferred embodiment thereof, it will be understood by those skilled in the art that various changes in form and details may be made therein without departing from the spirit and scope of the invention. For example, in another illustrative embodiment, it has been found that the arrangement of displaceable rollers 28, pivot arms 26, and solenoid 29 may be eliminated. In its place, a curved, fixed guide (such as, e.g. guide 96 but without the need for the cutouts 97) may be provided. The belts 24 extend from rollers 21, around the fixed guides in the path shown in FIG. 1, to the pulleys 22. All such modifications are intended to be within the scope of the invention, as defined in the following claims.

We claim:

1. A document handling device for documents movable along one of their edges, said device comprising a stacker section and a feeder section, wherein said stacker section includes:

transporting means for receiving documents moving upright on one of their edges, and for moving said documents longitudinally to a first position;

stop means for intercepting said document at said first position; and means for moving said document from said first position transversely to a stacking position, wherein said stacker section is arranged to receive successive documents in a series of documents, and position each successive document, in an upright position, behind the succeeding document to form an edgewise stack of documents; and wherein said feeder section includes:

feeder means for engaging the front document of said stack of documents for selectively removing the front document from a stack of documents, and for moving the front document from said stack in an upright manner along one edge, wherein said stacker section and said feeder section are arranged to support a stack of documents therebetween; and means for selectively actuating said feeder means for feeding the front document from the stack in an upright position, wherein said feeder means is slidably mounted on guide shafts so as to be laterally displaceable toward and away from said stacker section.

2. A document handling device for documents movable along one of their edges, said device comprising a stacker section and a feeder section, wherein said stacker section includes:

transporting means for receiving documents moving upright on one of their edges, and for moving said documents longitudinally to a first position;

stop means for intercepting said document at said first position; and means for moving said document from said first position transversely to a stacking position, wherein said stacker section is arranged to receive successive documents in a series of documents, and position each successive document, in an upright position, behind the succeeding document to form an edgewise stack of documents; and wherein said feeder section includes:

feeder means for engaging the front document of said stack of documents for selectively removing the front document from a stack of documents, and for moving the front document from said stack in an upright manner along one edge, wherein said stacker section and said feeder section are arranged to support a stack of documents therebetween, wherein said feeder means is displaceable toward and away from said stacker section to accommodate different size stacks of documents; and means for selectively actuating said feeder means for feeding the front document from the stack in an upright position, wherein said transporting means defines a first stationary document travel path, said device further including a swing arm means for receiving documents from said feeder means and for delivering them to a second stationary document travel path, said swing arm means being pivotally coupled between the feeder means and the second stationary document travel path.

3. A device as claimed in claim 2, wherein said transporting means comprises:

at least one first movable conveyor belt arranged to define a first document travel path;

a vacuum manifold means for selectively applying vacuum for holding documents against said first moveable conveyor belt; and a guide for moving documents entering the device against said first movable conveyor belt.

4. A device as claimed in claim 3, wherein said vacuum manifold means includes a manifold having apertures substantially in registry with said first movable conveyor belt, and wherein said first movable conveyor belt has apertures spaced along its length.

5. A device as claimed in claim 2, wherein said feeder means includes a feeder belt and a separator belt located on opposite sides of a feeder document travel path, wherein said feeder belt is arranged on one side of said feeder document travel path to engage the front document of a document stack for holding said stack and for selectively sliding the front document from the stack, and wherein said feeder and separator belts are arranged to move in opposite directions so as, when removing the outermost document from the stack, to push back any other documents entrained therewith.

6. A device as claimed in claim 5, wherein the actuator means for actuating said feeder means comprises drive means and clutch means for selectively coupling said drive means and said feeder belt for selectively removing the front document of a document stack.

7. A device as claimed in claim 2, wherein said swing arm means is pivotally connected to said feeder means and is pivotally connected to a carriage that is slideably mounted via bushings on stationary take-up shafts that are attached to positions adjacent the second document travel path.

8. A device as claimed in claim 2, wherein said swing arm means includes:

second movable conveyor belt means comprising a second conveyor belt, a plurality of first rollers for supporting said second conveyor belt, and a plurality of second rollers, said first and second rollers positioned along opposite sides of a swing arm document travel path, said second rollers being spring-loaded against said second conveyor belt to hold the documents against the second conveyor belt.

9. A device as claimed in claim 8, further including guide supports positioned along and above said second movable conveyor belt to guide the upper edge of the documents through the swing arm means.

10. A device as claimed in claim 3, wherein said stop means comprises a stop plate, and said transporting means further includes at least one third movable conveyor belt positioned between said first belt and said stop plate, said third movable conveyor belt is arranged to move the forward edges of documents from the first conveyor belt against said stop plate and to engage the previously transported sheet.

11. A device as defined in claim 10, comprising a guide means between said first belt and said stop plate and arranged to engage said third belt for defining a belt path between said guide means and said stop plate substantially parallel to said stack.

12. A document handling device for documents movable along one of their edges, said device comprising a stacker section and a feeder section, wherein said stacker section includes:

transporting means for receiving documents moving upright on one of their edges, and for moving said documents longitudinally to a first position;

stop means for intercepting said document at said first position; and means for moving said document from said first position transversely to a stacking position, wherein said stacker section is arranged to receive successive documents in a series of documents, and position each successive document, in an upright position, behind the succeeding document to form an edgewise stack of documents; and wherein said feeder section includes:

feeder means for engaging the front document of said stack of documents for selectively removing the front document from a stack of documents, and for moving the front document from said stack in an upright manner along one edge, wherein said stacker section and said feeder section are arranged to support a stack of documents therebetween; and means for selectively actuating said feeder means for feeding the front document from the stack in an upright position; wherein said transporting means comprises:

at least one first movable conveyor belt arranged to define a first document travel path;

a vacuum manifold means for selectively applying vacuum for holding documents against said first movable conveyor belt; and a guide for moving documents entering the device against said first movable conveyor belt; wherein said stop means further includes at least one second movable conveyor belt positioned between said first belt and said stop plate, said second movable conveyor belt is arranged to move the forward edges of documents from the first conveyor belt against said stop plate and to engage the previously transported sheet, and wherein said transporting means further includes solenoid-operated rollers positioned between said first belt and said stop plate for moving into contact with and assisting in moving the documents from the first conveyor belts to said stacking position.

13. A device as defined in claim 12, wherein said vacuum manifold means includes means for selectively applying compressed air to said documents for separating said documents from said first movable conveyor belts.

14. A device as defined in claim 2, wherein said transporting means includes guide means for defining a document transport path which, in the vicinity of said first position, is substantially parallel to said stack.

* * * * *